US007131202B2

(12) United States Patent
Pennell et al.

(10) Patent No.: US 7,131,202 B2
(45) Date of Patent: Nov. 7, 2006

(54) CUTTING MEMBERS FOR SHAVING RAZORS WITH MULTIPLE BLADES

(75) Inventors: Evan Pennell, Hingham, MA (US); Cheryl Fitzgerald, Tewksbury, MA (US); Cardy Louis, Raynham, MA (US)

(73) Assignee: The Gillette Company, Boston, TX (US)

( * ) Notice: Subject to any disclaimer, the term of this patent is extended or adjusted under 35 U.S.C. 154(b) by 205 days.

(21) Appl. No.: 10/798,525

(22) Filed: Mar. 11, 2004

(65) Prior Publication Data

US 2005/0198828 A1 Sep. 15, 2005

(51) Int. Cl.
*B26B 21/00* (2006.01)
*B26B 21/54* (2006.01)

(52) U.S. Cl. ..... 30/50

(58) Field of Classification Search ..... 30/50
See application file for complete search history.

(56) References Cited

U.S. PATENT DOCUMENTS

| | | | |
|---|---|---|---|
| 939,935 | A | 11/1909 | Wilcox |
| 1,290,664 | A | 1/1919 | Russell et al. |
| 1,479,690 | A | 1/1924 | Angst |
| 1,734,554 | A | 11/1929 | Behrman |
| 1,777,914 | A | 10/1930 | Davis |
| 1,821,825 | A | 9/1931 | Zumwalt |
| 1,853,867 | A | 4/1932 | Love |
| 1,890,334 | A | 12/1932 | Muros |
| 1,911,996 | A | 3/1933 | Gaieman et al. |
| 1,999,060 | A | 4/1935 | Rydner |
| 2,043,124 | A | 6/1936 | Smith et al. |
| 2,052,395 | A | 8/1936 | Geissler |
| 2,078,150 | A | 4/1937 | Masip et al. |
| 2,083,172 | A | 6/1937 | Smith |
| 2,094,240 | A | 9/1937 | Herrick et al. |
| D109,694 | S | 5/1938 | Berk |
| 2,118,498 | A | 5/1938 | Drew |
| 2,132,293 | A | 10/1938 | Harrer |
| 2,141,339 | A | 12/1938 | Bauerle |
| D126,066 | S | 3/1941 | Birrell |
| 2,263,885 | A | 11/1941 | McGauley |
| 2,275,517 | A | 3/1942 | Fay |

(Continued)

FOREIGN PATENT DOCUMENTS

| | | |
|---|---|---|
| CH | 416377 | 6/1966 |

(Continued)

OTHER PUBLICATIONS

International Search Report from a foreign patent office in a counterpart application.

(Continued)

*Primary Examiner*—Hwei-Siu Payer
(74) *Attorney, Agent, or Firm*—Fish & Richardson P.C.

(57) ABSTRACT

A cutting member for a shaving razor includes an elongated metal blade having a cutting edge, a blade end, a tapered portion near the blade end and a uniform thickness portion extending from the blade end to the tapered portion, and an elongated bent metal support that has a platform portion, a bent portion and a base portion extending downward from the bent potion. The platform portion extends forward from the bent portion to a front end. The platform portion includes an attachment area that is spaced from the front end and the bent portion, and a flat portion that includes and extends beyond the attachment area. The uniform thickness portion of the blade is supported on the platform portion and secured thereto at the attachment area, the tapered portion extending forward beyond the front end of the platform portion.

10 Claims, 4 Drawing Sheets

U.S. PATENT DOCUMENTS

| | | | |
|---|---|---|---|
| 2,309,549 | A | 1/1943 | Swann |
| D137,220 | S | 2/1944 | Brownback |
| 2,353,599 | A | 7/1944 | Swann et al. |
| D160,536 | S | 10/1950 | Reilly |
| 2,593,307 | A | 4/1952 | Jacobson |
| 2,662,281 | A | 12/1953 | Cerino |
| 2,704,397 | A | 3/1955 | Turgi |
| 2,720,695 | A | 10/1955 | Sabiers |
| 2,807,084 | A | 9/1957 | Harman |
| 2,837,820 | A | 6/1958 | Ostrowski |
| 2,848,806 | A | 8/1958 | Shnitzler et al. |
| 2,863,213 | A | 12/1958 | Rypysc |
| 2,934,776 | A | 5/1960 | Clemens |
| 3,061,926 | A | 11/1962 | Fjeran |
| 3,111,757 | A | 11/1963 | Dubofsky |
| 3,137,939 | A | 6/1964 | Waldeck |
| 3,172,202 | A | 3/1965 | Sooter |
| D204,672 | S | 5/1966 | Glaberson |
| 3,259,978 | A | 7/1966 | Weichselbaum |
| 3,299,508 | A | 1/1967 | Kuhnl |
| 3,358,368 | A | 12/1967 | Kuhnl |
| 3,383,764 | A | 5/1968 | Sachs |
| 3,391,458 | A | 7/1968 | Karr |
| 3,412,465 | A | 11/1968 | Andersen |
| 3,413,720 | A | 12/1968 | Mullen |
| D215,915 | S | 11/1969 | Bikien |
| D215,995 | S | 11/1969 | Harper |
| D216,657 | S | 2/1970 | Grange |
| D216,658 | S | 2/1970 | Edmondson |
| D217,752 | S | 6/1970 | Barry et al. |
| D219,699 | S | 1/1971 | Poisson |
| 3,593,416 | A | 7/1971 | Edson |
| 3,600,804 | A | 8/1971 | Brown |
| 3,626,591 | A | 12/1971 | Robey |
| 3,703,765 | A | 11/1972 | Perez |
| D228,315 | S | 9/1973 | Glaberson |
| 3,795,955 | A | 3/1974 | Dorian, Jr. |
| 3,795,979 | A | 3/1974 | Perry |
| 3,810,305 | A | 5/1974 | Perry |
| 3,823,471 | A | 7/1974 | Stone |
| D234,648 | S | 3/1975 | Braginetz |
| D239,060 | S | 3/1976 | Rees |
| D239,742 | S | 4/1976 | Rees |
| 3,972,115 | A | 8/1976 | Ross |
| D241,382 | S | 9/1976 | Jones |
| 4,017,970 | A | 4/1977 | Williams |
| 4,200,976 | A | 5/1980 | Gooding ..... 30/47 |
| 4,270,268 | A | 6/1981 | Jacobson |
| 4,281,456 | A | 8/1981 | Douglass et al. |
| 4,285,124 | A | 8/1981 | Diakonov |
| 4,378,633 | A | 4/1983 | Jacobson |
| 4,378,634 | A | 4/1983 | Jacobson |
| D271,531 | S | 11/1983 | Byrne |
| D271,625 | S | 11/1983 | Gray |
| 4,442,598 | A | 4/1984 | Jacobson |
| 4,446,619 | A | 5/1984 | Jacobson |
| 4,488,357 | A | 12/1984 | Jacobson |
| 4,492,024 | A | 1/1985 | Jacobson |
| 4,493,025 | A | 1/1985 | Bachman et al. |
| 4,498,235 | A | 2/1985 | Jacobson |
| 4,501,066 | A | 2/1985 | Sceberras |
| 4,534,110 | A | 8/1985 | Glass |
| 4,535,537 | A | 8/1985 | Ferraro et al. |
| 4,551,916 | A | 11/1985 | Jacobson |
| 4,573,266 | A | 3/1986 | Jacobson |
| 4,586,255 | A | 5/1986 | Jacobson |
| 4,621,424 | A | 11/1986 | Jacobson |
| 4,809,432 | A | 3/1989 | Schauble |
| 4,831,731 | A | 5/1989 | Eltis |
| D303,023 | S | 8/1989 | Sinclair |
| 4,901,437 | A | 2/1990 | Iten |
| 4,903,405 | A | 2/1990 | Halvey |
| D306,915 | S | 3/1990 | Luzenberg |
| D307,334 | S | 4/1990 | Ferraro et al. |
| D310,889 | S | 9/1990 | Comcialdi |
| D312,143 | S | 11/1990 | Schwartz |
| 4,970,784 | A | 11/1990 | Althaus et al. |
| D313,672 | S | 1/1991 | Tiegs |
| 4,993,154 | A | 2/1991 | Radcliffe |
| 5,018,274 | A | 5/1991 | Trotta |
| D318,142 | S | 7/1991 | Falchi |
| 5,027,511 | A | 7/1991 | Miller |
| 5,029,390 | A | 7/1991 | Reeves |
| 5,063,667 | A | 11/1991 | Jacobson |
| 5,067,238 | A | 11/1991 | Miller et al. |
| 5,113,585 | A | 5/1992 | Rogers et al. |
| D327,550 | S | 6/1992 | Chen et al. |
| 5,157,834 | A | 10/1992 | Chen et al. |
| 5,167,069 | A | 12/1992 | Quinn |
| 5,199,173 | A | 4/1993 | Hegemann et al. |
| 5,205,040 | A | 4/1993 | Werner |
| 5,236,439 | A | 8/1993 | Kozikowski |
| 5,269,062 | A | 12/1993 | Dallaire et al. |
| D343,026 | S | 1/1994 | Dallaire et al. |
| 5,282,814 | A | 2/1994 | Srivastava |
| D346,042 | S | 4/1994 | Chu |
| 5,307,564 | A | 5/1994 | Schoenberg |
| 5,333,383 | A | 8/1994 | Ferraro |
| 5,351,401 | A | 10/1994 | Werner |
| D353,020 | S | 11/1994 | Conti |
| 5,365,881 | A | 11/1994 | Sporn |
| D363,141 | S | 10/1995 | Burout et al. |
| 5,454,164 | A | 10/1995 | Yin et al. |
| 5,458,025 | A | 10/1995 | Neamtu |
| D364,706 | S | 11/1995 | Corcoran |
| D369,437 | S | 4/1996 | Armbruster et al. |
| 5,522,137 | A | 6/1996 | Andrews |
| 5,533,263 | A | 7/1996 | Gilder |
| 5,560,106 | A | 10/1996 | Armbruster et al. |
| 5,575,068 | A | 11/1996 | Pedersen |
| 5,579,580 | A | 12/1996 | Althaus et al. |
| 5,661,907 | A | 9/1997 | Apprille, Jr. |
| 5,687,485 | A | 11/1997 | Shurtleff et al. |
| 5,701,788 | A | 12/1997 | Wilson et al. |
| 5,704,127 | A | 1/1998 | Cordio |
| D392,417 | S | 3/1998 | Gray |
| D392,418 | S | 3/1998 | Gray |
| 5,761,814 | A | 6/1998 | Anderson et al. |
| D396,129 | S | 7/1998 | Gray |
| 5,784,790 | A | 7/1998 | Carson, III et al. |
| D397,512 | S | 8/1998 | Gray |
| 5,787,586 | A | 8/1998 | Apprille, Jr. et al. |
| 5,794,354 | A | 8/1998 | Gilder |
| 5,813,293 | A | 9/1998 | Apprille, Jr. et al. |
| 5,822,869 | A | 10/1998 | Metcalf et al. |
| 5,823,082 | A | 10/1998 | Wilson et al. ..... 83/152 |
| D403,112 | S | 12/1998 | Engel |
| D404,527 | S | 1/1999 | Gray |
| 5,855,071 | A | 1/1999 | Apprille, Jr. et al. |
| 5,865,189 | A | 2/1999 | Andrews |
| D406,393 | S | 3/1999 | Gray |
| D407,849 | S | 4/1999 | Gray |
| D407,850 | S | 4/1999 | Shurtleff |
| D407,851 | S | 4/1999 | Shurtleff |
| D408,101 | S | 4/1999 | Shurtleff |
| 5,915,791 | A | 6/1999 | Yin et al. |
| 5,918,369 | A | 7/1999 | Apprille, Jr. et al. |
| 5,956,851 | A | 9/1999 | Apprille, Jr. et al. |
| D416,108 | S | 11/1999 | Shurtleff et al. |
| D416,646 | S | 11/1999 | Pinchuk |
| D417,034 | S | 11/1999 | Shurtleff |
| 6,009,624 | A | 1/2000 | Apprille, Jr. et al. |
| 6,026,577 | A | 2/2000 | Ferraro |
| 6,029,354 | A | 2/2000 | Apprille, Jr. et al. |

| | | | | |
|---|---|---|---|---|
| D422,117 | S | 3/2000 | Motta | |
| 6,035,537 | A | 3/2000 | Apprille, Jr. et al. | |
| 6,044,542 | A | 4/2000 | Apprille, Jr. et al. | |
| 6,052,903 | A | 4/2000 | Metcalf et al. | |
| RE36,816 | E | 8/2000 | Apprille, Jr. et al. | |
| D429,034 | S | 8/2000 | Shurtleff | |
| D431,680 | S | 10/2000 | Wagstaff | |
| 6,141,875 | A | 11/2000 | Andrews | |
| 6,145,201 | A | 11/2000 | Andrews | |
| 6,161,288 | A * | 12/2000 | Andrews | 30/50 |
| 6,185,823 | B1 | 2/2001 | Brown et al. | |
| 6,192,586 | B1 | 2/2001 | Metcalf et al. | |
| 6,212,777 | B1 | 4/2001 | Gilder et al. | |
| 6,216,345 | B1 | 4/2001 | Andrews | |
| 6,216,349 | B1 | 4/2001 | Gilder et al. | |
| 6,237,232 | B1 | 5/2001 | Petricca et al. | |
| D444,267 | S | 6/2001 | Gray | |
| D445,958 | S | 7/2001 | Dansreau et al. | |
| D446,884 | S | 8/2001 | Kohring et al. | |
| 6,272,061 | B1 | 8/2001 | Kato et al. | |
| 6,276,061 | B1 | 8/2001 | Rozenkranc | |
| D458,410 | S | 6/2002 | Shepperson | |
| 6,418,623 | B1 | 7/2002 | Marcarelli | |
| 6,449,849 | B1 | 9/2002 | Hackerman | |
| D467,387 | S | 12/2002 | Wonderley | |
| 6,526,660 | B1 | 3/2003 | MacNeil | |
| 6,598,303 | B1 | 7/2003 | Bosy et al. | |
| 6,601,272 | B1 | 8/2003 | Stvartak et al. | |
| 6,629,475 | B1 | 10/2003 | Neamtu et al. | |
| 6,651,342 | B1 | 11/2003 | Walker, Jr. | |
| 6,675,479 | B1 | 1/2004 | Walker, Jr. et al. | |
| 2002/0144404 | A1 | 10/2002 | Gilder et al. | |
| 2003/0204954 | A1 | 11/2003 | Wain | |
| 2003/0208907 | A1 | 11/2003 | Brown, Jr. et al. | 30/50 |
| 2005/0198837 | A1 * | 9/2005 | Rawle | 30/346.57 |

FOREIGN PATENT DOCUMENTS

| | | |
|---|---|---|
| DE | 206980 | 2/1908 |
| DE | 1 949 400 | 8/1970 |
| DE | 43 13 371 | 10/1993 |
| EP | 0 011 452 | 5/1980 |
| EP | 1 252 982 | 10/2002 |
| FR | 2 632-886 | 12/1989 |
| GB | 548648 | 10/1942 |
| GB | 2 055 069 A | 2/1981 |
| GB | 1 587 317 | 4/1981 |
| GB | 1 591 095 | 6/1981 |
| GB | 1 487 834 | 10/1997 |
| JP | 49-76885 | 7/1974 |
| JP | 56-43984 | 4/1981 |
| JP | 3-88467 | 4/1991 |
| JP | 4-83176 | 7/1992 |
| JP | 7-506503 | 7/1995 |
| JP | 52-137991 | 10/1997 |
| NL | 7603885 | 10/1977 |
| WO | WO 94/11163 | 5/1994 |
| WO | WO 96/01171 | 1/1996 |
| WO | WO 97/37818 | 10/1997 |
| WO | WO 97/37819 | 10/1997 |
| WO | WO 98/05478 | 2/1998 |
| WO | WO 99/14020 | 3/1999 |
| WO | WO 99/39883 | 8/1999 |

OTHER PUBLICATIONS

Written Opinion from a foreign patent office in a counterpart application.

* cited by examiner

CUTTING MEMBERS FOR SHAVING RAZORS WITH MULTIPLE BLADES

BACKGROUND OF THE INVENTION

The invention relates to cutting members for shaving razors with multiple blades.

In recent years shaving razors with various numbers of blades have been proposed in the patent literature and commercialized, as described, e.g., in U.S. Pat. No. 5,787,586, which generally describes a type of design that has been commercialized as the three-bladed Mach III razor by The Gillette Company, and U.S. Published Patent Application No. 2002/0144404, which describes three- and four-bladed razors.

Increasing the number of blades on a shaving razor generally tends to increase the shaving efficiency of the razor and provide better distribution of compressive forces on the skin but it can also tend to increase drag forces, reduce maneuverability, and reduce the ability to trim. Increasing the number of blades also requires increasing the area occupied by blades or reducing the spacing between the cutting edges of the blades. Increasing the area occupied by blades can affect shaving performance. Reducing the spacing between blades results in a change on the skin bulge between cutting edges and the effectiveness of the shave, potentially requiring changes in other parameters in blade geometry such as blade tangent angle and exposure. Increasing the number of blades can also affect the rinsability of the razor, which affects the ability to remove shaving debris from the blade area.

U.S. Pat. No. 5,787,586 shows razor blades that are mounted on bent metal supports, a type of support that has been reliably manufactured for years by The Gillette Company in both the Sensor and Mach III commercial products. U.S. Published Patent Application No. 2002/0144404 describes three- and four-bladed designs with straight metal support bars as blade supports and a test procedure for determining a wash through index indicating the ability of a shaving razor cartridge to be rinsed to remove shaving debris. The latter document notes that the support bars contributed to the good wash through index values reported for the described embodiments.

SUMMARY OF THE INVENTION

The invention features, in general, a cutting member for a shaving razor that includes an elongated metal blade and an elongated bent metal support that has an elongated platform portion, an elongated bent portion and an elongated base portion. In general, the blade and platform portion of the blade support are sized to make them more compact at the same time that the platform portion is provided with a sufficiently flat area for reliably supporting the blade. The platform portion extends forward from the bent portion to a front end, and includes an attachment area (e.g., a weld area) that is spaced from the front end and from the bent portion. The platform portion also includes a flat portion that includes and extends beyond the attachment area. The elongated metal blade has a cutting edge at the front, a blade end at the rear, a tapered portion leading to the cutting edge and a uniform thickness portion extending from the blade end at the rear to the tapered portion. The uniform thickness portion of the blade is supported on the platform portion and secured to the platform portion at the attachment area, and the tapered portion extends forward beyond the front end of the platform portion.

In one aspect of the invention, the blade is less than 1 mm in length from the cutting edge to the blade end, preferably less than 0.9 mm, and most preferably about 0.85 mm.

In another aspect of the invention, the platform portion of the blade support is less than 0.7 mm in length from the front end to the bent portion, preferably less than 0.6 mm, and most preferably about 0.55 mm.

In another aspect of the invention, the elongated bent metal support is made of metal that is between 0.004" and 0.009" thick (preferably between 0.005" and 0.007" and most preferably about 0.006"), and the bent portion has a radius of curvature that is less than 0.1 mm (preferably less than 0.09 mm and most preferably metal less than 0.08 mm).

In another aspect the invention features, in general, a shaving razor blade unit including at least four (preferably at least five) cutting members as already described with inter-blade spans less than 1.2 mm, preferably less than 1.1 mm, and most preferably about 1.05 mm.

Particular embodiments of the invention may include one or more of the following features. The angle between the base portion and the platform portion is between 109° and 115°, preferably between 110° and 113°, most preferably about 111.5°. The blades are secured to the platform portion by welding.

Embodiments of the invention may include one or more of the following advantages. Cutting members according to the invention can be reliably manufactured and are sufficiently compact to permit use in multi-blade razors, with at least 4 or 5 blades, while reducing spans and maintaining good rinsability.

Other advantages and features of the invention will be apparent from the following description of particular embodiments and from the claims.

The details of one or more embodiments of the invention are set forth in the accompanying drawings and the description below. Other features, objects, and advantages of the invention will be apparent from the description and drawings, and from the claims.

DETAILED DESCRIPTION OF PARTICULAR EMBODIMENTS

Figure 1:
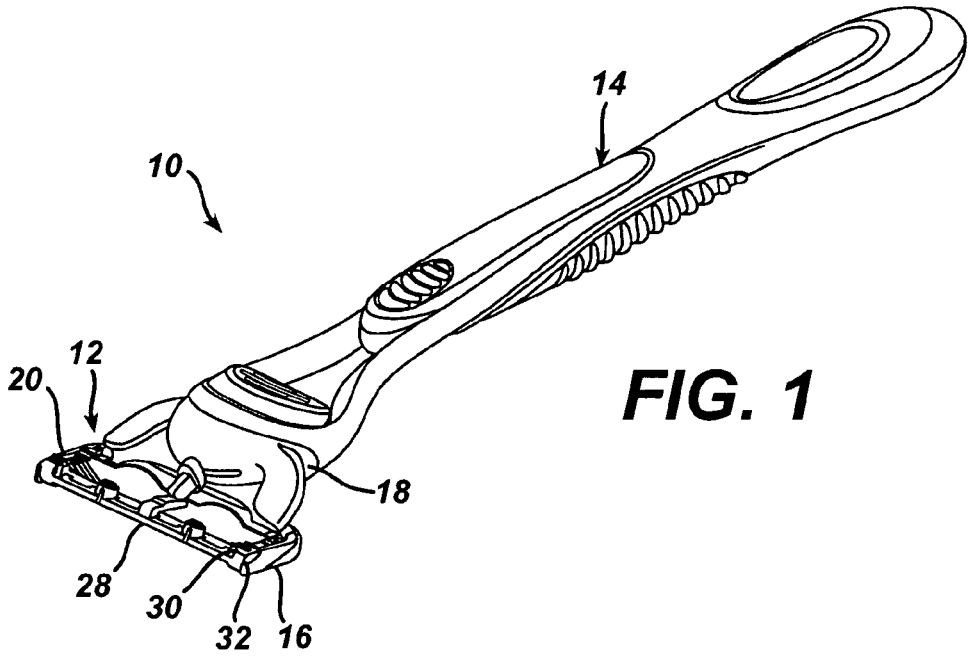
FIG. 1 is a perspective view of a shaving razor.
Figure 2:
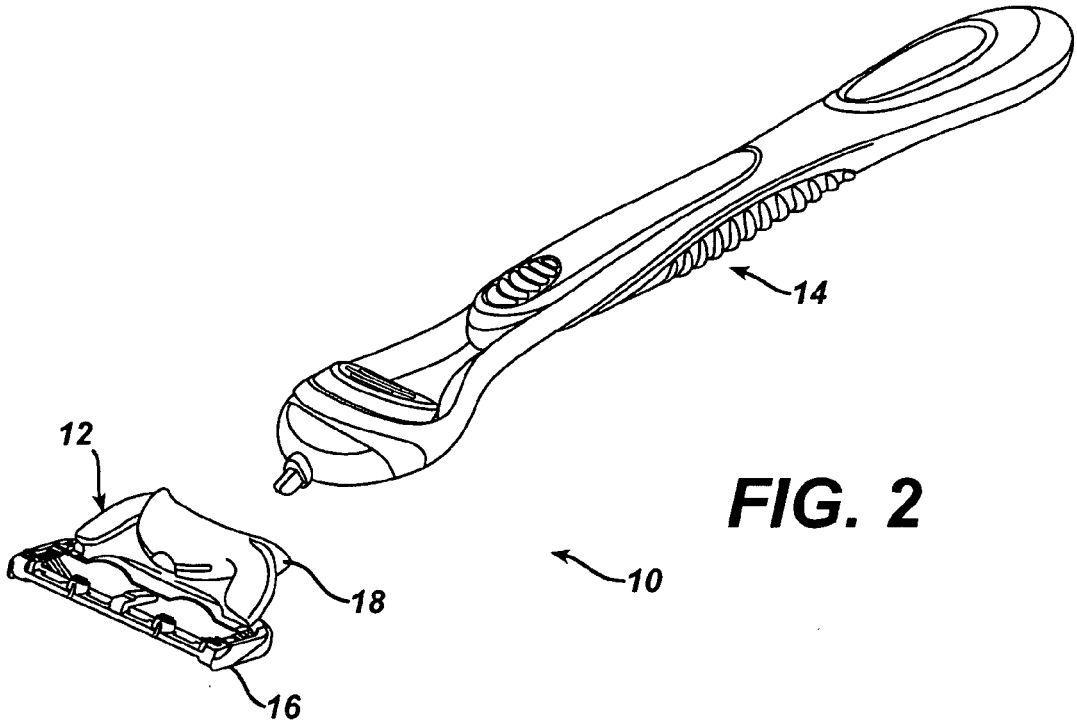
FIG. 2 is a perspective view of the FIG. 1 razor showing its replaceable cartridge separated from its handle.
Figure 3:
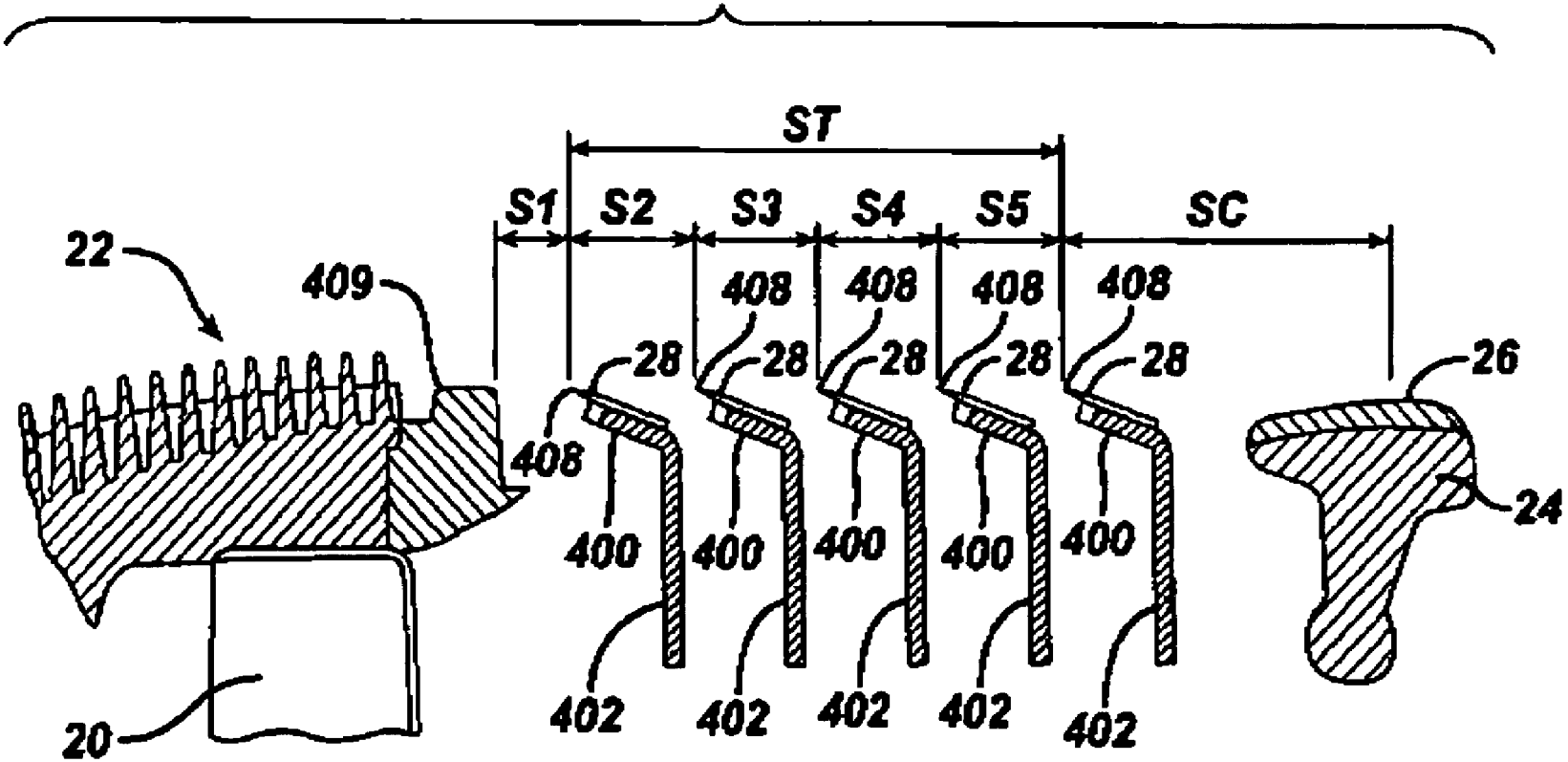
FIG. 3 is vertical sectional view showing the relative positions of some of the components of a cartridge of the FIG. 1 razor.

Referring to FIGS. 1 and 2, shaving razor 10 includes disposable cartridge 12 and handle 14. Cartridge 12 includes a connecting member 18, which connects to handle 14, and a blade unit 16, which is pivotally connected to connecting member 18. Blade unit 16 includes plastic housing 20, primary guard 22 at the front of housing 20, cap 24 with lubricating strip 26 at the rear of housing 20, five elongated blades 28 between primary guard 22 and primary cap 24, and trimming blade assembly 30 attached to the rear of housing 20 by clips 32, which also retain blades 28 on housing 20.

Referring to FIGS. 3–6, it is seen that each elongated blade 28 is supported on a respective elongated bent support 400 having an elongated lower base portion 402, an elongated bent portion 404 and an elongated platform portion 406 on which the blade 28 is supported. The blade span is defined as the distance from the blade edge to the skin contacting element immediately in front of that edge as measured along a tangent line extending between the element and the blade edge. The cutting edges 408 of each blade are separated from cutting edges 408 of adjacent blades by the inter-blade span distance S2=S3=S4=S5; the inter-blade span is between 0.95 mm and 1.15 mm, preferably between 1.0 mm and 1.1 mm and most preferably about 1.05 mm. The blade exposure is defined to be the perpendicular distance or height of the blade edge measured with respect to a plane tangential to the skin contacting surfaces of the blade unit elements next in front of and next behind the edge. Because the cutting edges all rest against clips 32 when at rest, they are in a common plane, such that the exposures of the three intermediate blades are zero. The front blade 28 has a negative exposure of −0.04 mm, and the last blade 28 has a positive exposure. The span S1 from the front rail 409 to the cutting edge of the front blade 28 is 0.65 mm, and the distance SC from the cutting edge of the last blade 28 to the tangent point on lubricating strip 26 of cap 24 is 3.16 mm. The distance ST from the first cutting edge 408 to the last cutting edge 408 is four times the inter-blade span and thus is between 3.8 mm and 4.6 mm, preferably between 4.0 mm and 4.4 mm and most preferably about 4.2 mm, i.e., between 4.1 mm and 4.3 mm.

Figure 4:
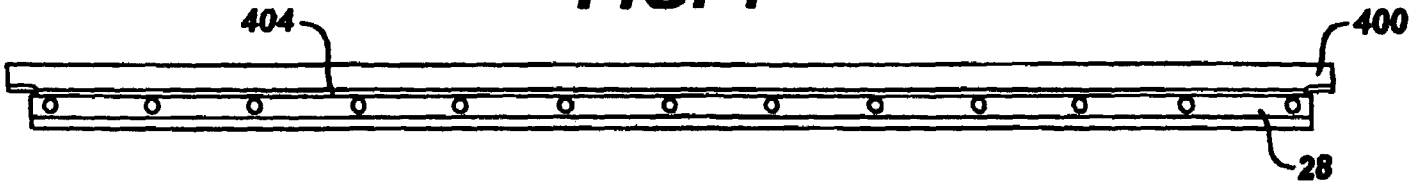
FIG. 4 is a top view of a cutting member of the FIG. 3 cartridge.
Figure 5:
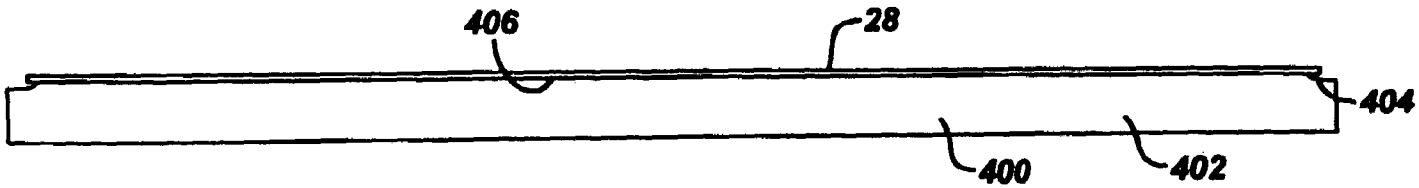
FIG. 5 is a front view of the FIG. 4 cutting member.
Figure 6:
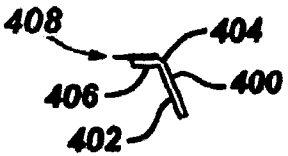
FIG. 6 is a vertical sectional view of the FIG. 4 cutting member.
Figure 7:
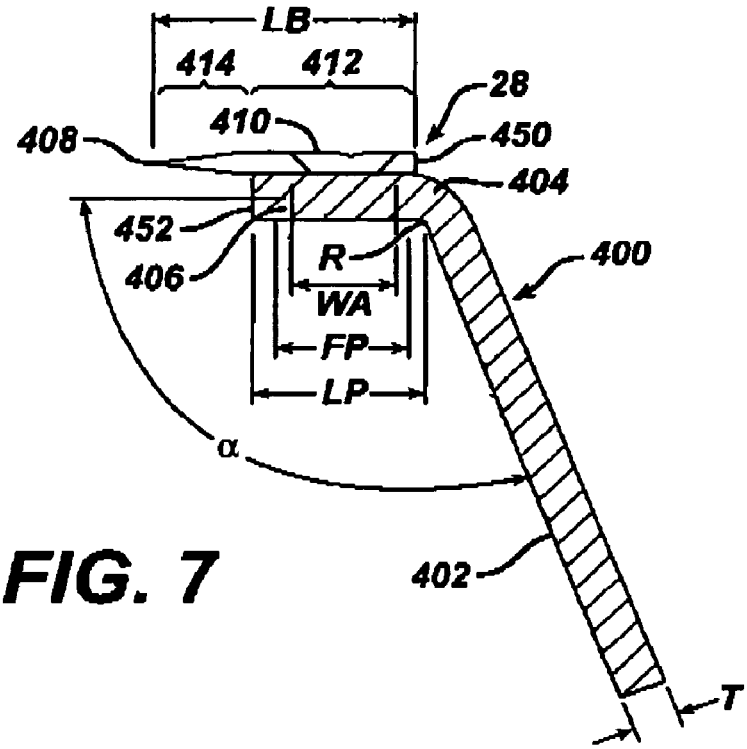
FIG. 7 is an enlarged vertical sectional view of the FIG. 4 cutting member.

Referring to FIGS. 4–6, blade 28 is connected to platform portion 406 by thirteen spot welds 410 applied by a laser that melts the metal of blade 28 at the weld area WA to create molten metal, which forms the weld 410 to platform portion 406 upon cooling. The weld area WA is an area of attachment at which the blade is secured to the platform portion. Referring to FIG. 7, the weld area WA is located within a flat portion FP of platform portion 406. The blade length LB from cutting edge 408 to blade end 450 is less than 1 mm, preferably less than 0.9 mm, and most preferably about 0.85 mm. Blade 28 has a uniform thickness portion 412 that is supported on platform portion 406 and a tapered portion 414 that extends beyond the front end 452 of platform portion 406.

Elongated bent metal support 400 is made of metal that is between 0.004" and 0.009" thick (dimension T), preferably metal between 0.005" and 0.007" thick, and most preferably metal about 0.006" thick. Platform portion 406 has a length LP length from its front end 452 to the bent portion 404 less than 0.7 mm, preferably less than 0.6 mm, and most preferably about 0.55 mm. The bent portion 404 has an inner radius of curvature R that is less than 0.1 mm, preferably less than 0.09 mm and most preferably less than 0.08 mm. The angle $\alpha$between base portion 402 and platform portion 406 is between 108° and 115°, preferably between 110° and 113°, most preferably about 111.5°.

Figure 8:
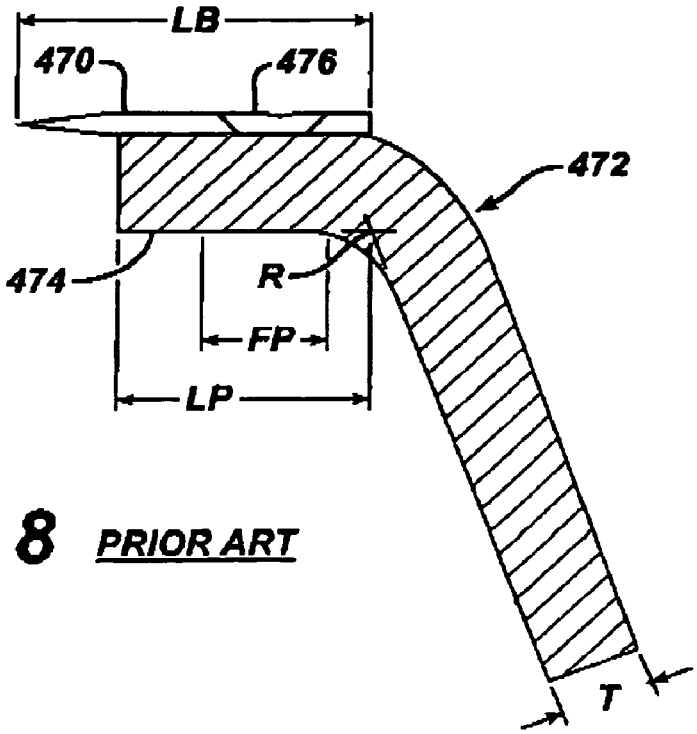
FIG. 8 PRIOR ART
FIG. 8 is a vertical sectional view of a prior art cutting member.

FIG. 8 is a schematic representation of a blade 470 and angled support 472 used in the Mach III shaving razor. Blade 470 has a blade length LB of 1.23 mm. Support 472 is made of metal 0.011" thick, has a platform portion 474 with a length LP of 0.83 mm (tolerance +0.10−0.05) and a radius of curvature R of 0.20 mm (max). Platform portion 474 is crowned, with curvature beyond the flat portion FP at which weld 476 is located. Flat portion FP has a minimum dimension of 0.3 mm. In the shaving cartridge, the inter-blade span is 1.50 mm, such that the distance from the cutting edge of the front blade to the cutting edge of the last blade is 3.00 mm. If the same inter-blade span were maintained in a shaving razor cartridge with five blades, the distance from the cutting edge of the front blade to the cutting edge of the last blade would be 6.00 mm. If the same blades 470 and angled supports 472 were used with smaller inter-blade spans, the reduced spaces between adjacent blades 470 and angled supports 472 would increase possibility of reduced rinsability, with increased likelihood of retention of shaving debris in the blade area and reduced shaving performance.

Referring to FIG. 7, because angled support 400 is cut and formed from thinner metal, it facilitates providing a reduced radius of curvature R, thereby permitting a greater percentage of the platform portion to be flat. The use of thinner material for the support also facilitates the ability to provide a larger percentage of the platform area flat after forming. A minimum size flat area is needed to accurately and reliably support blade 28, which has a reduced length for its uniform thickness portion 412, owing to the shorter length. The shorter uniform thickness portion 412 can be employed, while still maintaining necessary accurate blade support, because the extent of curved areas of platform portion 406 outside of the flat area FP has been reduced. Such accurate blade support is necessary to provide desired blade geometry for desired shaving performance.

Other embodiments of the invention are within the scope of the appended claims. E.g., the blades can be attached to the bent supports by other welding techniques, e.g., arc welding, or by other attachment techniques such as adhesives or stitching.

What is claimed is:

1. A cutting member for a shaving razor comprising an elongated metal blade that has a cutting edge, a blade end, a tapered portion near said cutting edge and a uniform thickness portion extending from said blade end to said tapered portion, and an elongated bent metal support that has an elongated platform portion, an elongated bent portion and an elongated base portion, said platform portion extending forward from said bent portion to a front end, said elongated base portion extending downward from said bent portion, said platform portion including an attachment area that is spaced from said front end and from said bent portion, said platform portion including a flat portion that includes and extends beyond said attachment area, said uniform thickness portion of said blade being supported on said platform portion and secured to said platform portion at said attachment area, said tapered portion extending forward beyond said front end of said platform portion, said elongated bent metal support being made of metal that is between 0.004" and 0.009" thick, said bent portion having a radius of curvature that is less than 0.1 mm.

2. The cutting member of claim 1 wherein said platform portion is less than 0.7 mm in length from said front end to said bent portion.

3. The cutting member of claim 2 wherein said platform portion is less than 0.6 mm in length from said front end to said bent portion.

4. The cutting member of claim 1 wherein said elongated bent metal support is made of metal that is between 0.005" and 0.007" thick.

5. The cutting member of claim 1 wherein said elongated bent metal support is made of metal that is about 0.006" thick.

6. The cutting member of claim 1 wherein said platform portion is about 0.55 mm in length from said front end to said bent portion.

7. The cutting member of claim 1 wherein the angle between said base portion and said platform portion is between 108° and 115°.

8. The cutting member of claim 1 wherein the angle between said base portion and said platform portion is between 110° and 113°.

9. The cutting member of claim 1 wherein the angle between said base portion and said platform portion is about 111.5°.

10. The cutting member of claim 1 wherein said blade is secured to said attachment area by a weld.

* * * * *

UNITED STATES PATENT AND TRADEMARK OFFICE

CERTIFICATE OF CORRECTION

PATENT NO. : 7,131,202 B2
APPLICATION NO. : 10/798525
DATED : November 7, 2006
INVENTOR(S) : Evan Pennell, Cheryl Fitzgerald and Cardy J. Louis It is certified that error appears in the above-identified patent and that said Letters Patent is hereby corrected as shown below:

On the cover Title, section (73) Assignee: delete "TX" and insert --MA--.

On the cover Title, section (57) Abstract, line 7, delete "potion" and insert --portion--.

Signed and Sealed this

Twentieth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,131,202 B2
APPLICATION NO. : 10/798525
DATED : November 7, 2006
INVENTOR(S) : Evan Pennell, Cheryl Fitzgerald and Cardy J. Louis It is certified that error appears in the above-identified patent and that said Letters Patent is hereby corrected as shown below:

On the title page, item (73) Assignee: delete "TX" and insert --MA--.

On the title page, item (57) Abstract, line 7, delete "potion" and insert --portion--.

Signed and Sealed this

Eleventh Day of December, 2007

JON W. DUDAS
*Director of the United States Patent and Trademark Office*